US006402468B1

(12) United States Patent
Florin et al.

(10) Patent No.: US 6,402,468 B1
(45) Date of Patent: Jun. 11, 2002

(54) METHOD AND APPARATUS FOR AXIALLY ALIGNING INNER AND OUTER TURBINE SHELL COMPONENTS

(75) Inventors: Mark Arne Florin, Ballston Spa; Michael Thomas Hamlin, Schoharie; Michael Earl Montgomery, Niskayuna; Richard Lloyd Mattice, Broadalbin; Jeyaruban Selliah Amirtharajah, Schenectady; Dennis Roger Ahl, Sprakers; Bruce William Brisson, Galway, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,854

(22) Filed: Jun. 18, 2001

(51) Int. Cl.[7] ..... F01D 25/24

(52) U.S. Cl. ..... 415/214.1; 415/108

(58) Field of Search ..... 415/214.1, 138, 415/220, 213.1, 108, 209.2, 209.3; 403/355, 356, 358, 374.1; 29/889.2, 888.02

(56) References Cited

U.S. PATENT DOCUMENTS

| | | | | |
|---|---|---|---|---|
| 4,537,560 A | | 8/1985 | Emeterio et al. | |
| 5,123,812 A | * | 6/1992 | Groenendaal et al. | 29/264 |
| 5,913,658 A | | 6/1999 | Sexton et al. | |
| 6,079,943 A | | 6/2000 | Sexton et al. | |
| 6,082,963 A | | 7/2000 | Sexton et al. | |
| 6,224,332 B1 | | 5/2001 | Leach et al. | |

* cited by examiner

*Primary Examiner*—Christopher Verdier
*Assistant Examiner*—Kimya McCoy
(74) *Attorney, Agent, or Firm*—Nixon & Vanderhye P.C.

(57) ABSTRACT

A turbine shell assembly includes radially inner and outer shell components; axial alignment fits on the inner and outer shell components, each alignment fit comprising a male fit component on one of the inner and outer shell components and a female fit component on the other of the inner and outer shell components, the female fit component comprising a pair of flanges forming a U-shaped channel with opposed faces, and the male fit component comprising a projection received within the U-shaped channel; and a pair of axial alignment keys, each key having a mounting flange for securement along an outer edge of a respective one of the pair of flanges and an alignment flange engaged along a respective one of the opposed faces.

18 Claims, 3 Drawing Sheets

METHOD AND APPARATUS FOR AXIALLY ALIGNING INNER AND OUTER TURBINE SHELL COMPONENTS

BACKGROUND OF INVENTION

This invention relates to techniques for axially aligning radially inner and outer shell components of steam turbines, particularly useful in field applications.

In double shell type turbine construction, alignment of the inner shell to outer shell is typically accomplished by male-to-female fit components on both upper and lower separable halves of the inner and outer shell components. Thus, there are two pairs of axial alignment fits, one pair between the upper halves of the radially inner and outer turbine shell components, and a second pair between the lower halves of the inner and outer turbine shell components. Often, these fits are strictly for axial positioning of the inner shell relative to the outer shell. During replacement of the inner shell for conversion, modernization, or uprate, the new inner shell is initially machined with additional material on the axial fits to allow for field machining to obtain the proper axial alignment. Benchmarking allows the correct axial position to be determined; however, the necessary equipment to machine the inner shell fits is not available in the field. This requires transport of the inner shell to a local machining facility, setup, machining and transport back to the power generation site, resulting in costly delays in the installation cycle.

SUMMARY OF INVENTION

This invention relates to a new design for locally machinable keys for each female fit component that facilitates axial alignment of the inner and outer turbine shell components. Once the correct axial position of the inner to outer shell is determined, the keys may be machined in the field to the correct thickness that will insure correct axial alignment. The keys are made to be easily assembled and disassembled for turbine maintenance, and may be reused.

In the exemplary embodiment, a pair of "L" shaped keys are dimensionally sized according to the axial alignment fit dimensions. Each axial alignment fit includes a female component on the inner shell with a pair of adjacent, horizontally outwardly extending projections or flanges forming a slot or channel, and a male component on the outer shell, with a single horizontally inwardly extending projection or flange adapted to fit in the slot or channel of the female component. Two keys are placed in each female component of the fit, (a left and a right handed key, one on each of the female fit component flanges), and bolts or cap screws are used to retain each key on the fit. The position of the screws prevents distortion of the keys in the radial direction during thermal transients. Two dowels are also included for shear strength in the vertical direction during disassembly, and for further insuring axial alignment of the inner and outer shells after the final positioning. The faces of the keys are engaged by the male component on the outer shell are surfaced with stellite to provide for ease of disassembly. The weight of each key is approximately 40 pounds, which provides for ease of installation by a single field technician and alleviates the need for complex lifting equipment.

Accordingly, in its broader aspects, the invention relates to a turbine shell assembly comprising radially inner and outer shell components; axial alignment fits on said inner and outer shell components, each alignment fit comprising a male component on one of said inner and outer shell components and a female component on the other of said inner and outer shell components, the female component comprising a pair of tabs forming a U-shaped channel with opposed faces, and the male component comprising a projection received within said U-shaped channel; and a pair of axial alignment keys, each key having a mounting flange for securement along an outer edge of a respective one of said pair of tabs and an alignment flange engaged along a respective one of said opposed faces.

In another aspect, the invention relates to an alignment key for a female fit component on a turbine shell component, the key comprising a mounting flange and an alignment flange, the mounting flange having a plurality of fastener holes therein that are oversized relative to fasteners adapted for use therewith; the alignment flange extending perpendicularly relative to said mounting flange, the alignment flange having a hardened face thereon.

In still another aspect, a method of axially aligning inner and outer turbine shell components each having upper and lower halves comprising a) providing a first pair of axial alignment fits between the upper halves of the radially inner and outer turbine shell components, and a second pair of axial fit components between the lower halves of the radially inner and outer turbine shell components, each axial alignment fit comprising a male fit component and a female fit component, the female fit component comprising a pair of tabs forming a U-shaped channel with opposed faces, and the male fit component comprising a projection adapted to be received within the U-shaped channel; b) axially aligning the radially inner and outer shell components; c) providing a pair of alignment keys for each axial alignment fit, each key having a mounting flange for securement along a respective outer edge of a respective one of the tabs, and an alignment flange engageable along a respective one of the opposed faces; d) determining the precise location of the male fit component within the U-shaped channel; e) machining one or both of each the pair of alignment keys along back faces of the alignment flanges to enable the precise location; f) fastening the keys to the outer edges with a plurality of fasteners; g) drilling dowel holes in the mounting flange and into the radial edge; and h) inserting dowel pins within the dowel holes.

DETAILED DESCRIPTION

Figure 1:
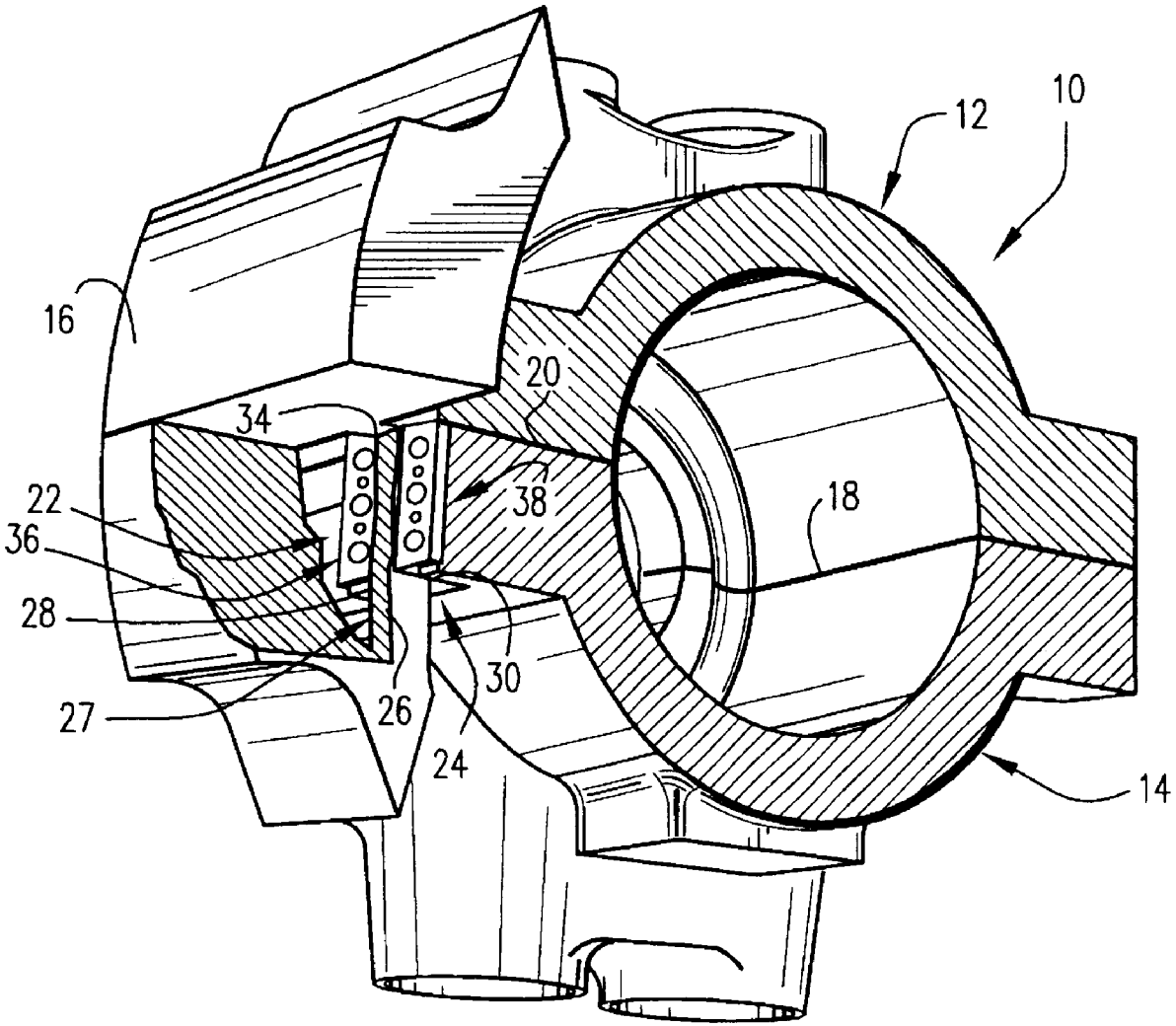
FIG. 1 is a simplified perspective view, partly in section, of a turbine shell provided with a pair of alignment keys in accordance with the invention, mounted in place on the alignment fit of a lower, inner turbine shell component.

A simplified illustration of a turbine shell assembly 10 (FIG. 1) includes upper and lower inner shell components 12, 14 and part of an upper, radially outer shell component 16. The upper and lower parts of both the inner and outer shell components are typically joined along diametrically opposed horizontal interfaces indicated at 18, 20. A single axial alignment fit 22 is shown between the lower radially inner and outer shell components 14 and 27, but it will be appreciated that another axial alignment fit is located directly above the fit 22, between the upper radially inner and outer shell components. Another pair of axial alignment fits (not shown) is located diametrically opposite the fit 22. Since the four fits are substantially identical, only one need be described in detail.

Figure 3:
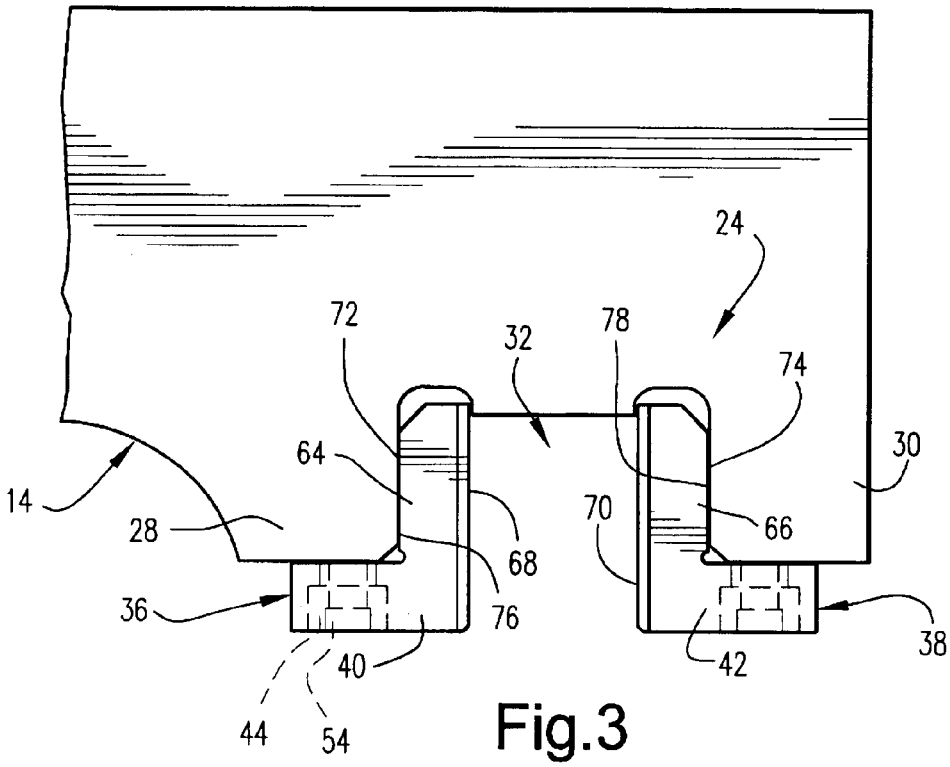
FIG. 3 is a plan view of the alignment keys of FIG. 2.

The alignment fit 22 includes a female fit component 24 (FIGS. 1 and 3) and a male fit component 26 (FIG. 1). The female fit component 24 is formed by a pair of-vertically oriented, laterally spaced tabs or flanges 28, 30, creating a groove or channel 32 therebetween. The tabs or flanges 28, 30 project horizontally away from the turbine shell components (12, 14) while the male fit component 26 (FIG. 1) is a projection or flange that extends horizontally inwardly from the lower, radially outer shell component 27. It is noted, however, that the male fit component 34 of the upper, radially outer shell component 16 (FIG. 1) is located directly above the male fit component 26 of the lower radially outer shell component 27. The insertion of the male fit component 26 into the channel 32 of the female fit component 24 will axially align the lower, radially inner and outer turbine shell components 14 and 27 (FIG. 1). The invention is not limited, however, to the male fit/female fit orientation described above. For example, the male fit components could be located on the inner shell component and the female fit components on the outer shell component.

Figure 2:
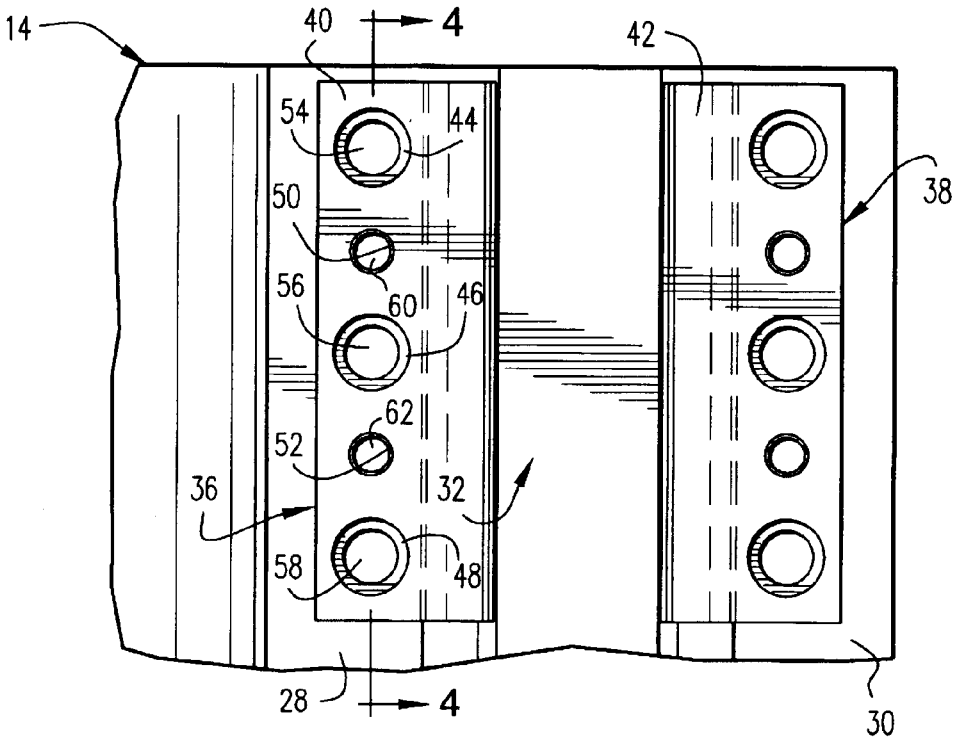
FIG. 2 is a side elevation of the alignment keys in accordance with the invention.
Figure 4:
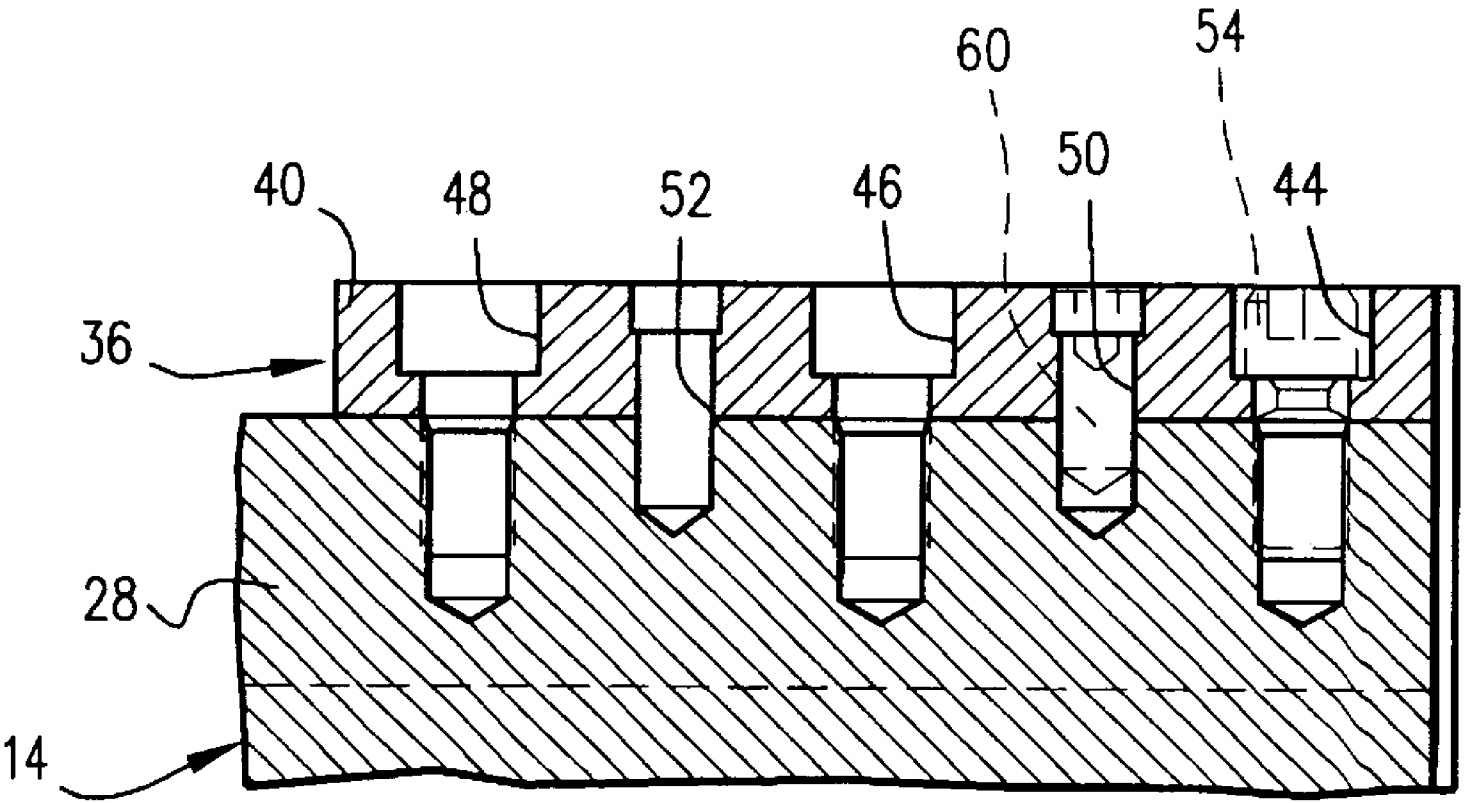
FIG. 4 is a section taken along the line 4—4 of FIG. 2.

This invention relates to the use of alignment keys 36, 38 that are mounted on the female fit component 24 as further described below. The keys 36, 38 are substantially identical mirror images of each other, i.e., one is left handed and one is right handed. The keys 36, 38 (FIGS. 2–4) have respective mounting flanges 40, 42, each of which is provided with fastener holes 44, 46 and 48 and dowel pin holes 50, 52 that receive respective cap screws 54, 56 and 58 (or other suitable fasteners) and dowel pins 60, 62. The cap screws and dowel pins are preferably staked or otherwise secured by suitable means to prevent loss during operation. The mounting flanges engage outer edges of the flanges 28, 30.

The keys are also formed with respective alignment flanges 64, 66 that extend perpendicularly relative to respective mounting flanges 40, 42. The alignment flanges have hardened alignment faces 68, 70 that extend into the channel 32 and face each other, thus engaging opposite sides of the male component 26 when the latter is fully seated in the channel. The keys are also formed with respective back or rear surfaces 72, 74 that lie, respectively, on opposite sides of the alignment flanges 64, 66, and that engage respective inner or facing surfaces 76, 78 of the female fit component flanges 28, 30 forming the channel 32 of the female fit component.

In use, the outer, lower shell component 27 typically remains fixed in place during repairs, conversions, updates, etc. The desired axial position of the lower inner and outer shell components 14, 27 can be determined by measurement. For each of the four axial alignment fits, the keys 36, 38 are then sized to take up the slack between the male fit and female fit components. In this regard, the back or rear faces 72, 74 are precision machined to achieve the desired axial position of the male fit component 26 within the channel 32 of the female fit component 24. These rear faces are machined because the hardened alignment faces or layers 68, 70 are surfaced with a hardened, wear resistant material to provide for ease of assembly and disassembly without significant wear on the keys.

The axial shifting of the keys to the exact desired position is also enabled by slightly oversizing the fastener holes 44, 46 and 48 in the mounting flanges 40, 42. This arrangement is apparent from FIGS. 2 and 4. Once the keys are properly located and the cap screws tightened, the dowel holes 50, 52 are drilled through the key mounting flanges and into the flanges 28, 30 of the female fit component 24. Insertion of the dowel pins 60, 62 completes the alignment procedure and fixes the keys to the female fit component. This procedure is followed at each of the fit locations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine shell assembly comprising radially inner and outer shell components; axial alignment fits on said inner and outer shell components, each alignment fit comprising a male fit component on one of said inner and outer shell components and a female fit component on the other of said inner and outer shell components, the female fit component comprising a pair of tabs forming a U-shaped channel with opposed faces, and the male fit component comprising a projection received within said U-shaped channel; and a pair of axial alignment keys, each key having a mounting flange for securement along an outer edge of a respective one of said pair of tabs and an alignment flange engaged along a respective one of said opposed faces.

2. The assembly of claim 1 wherein said mounting flange is provided with a plurality of fastener holes, and a like number of fasteners secure said mounting flange to said outer edge.

3. The assembly of claim 2 wherein said mounting flange is provided with a plurality of dowel holes.

4. The assembly of claim 1 wherein said alignment flange of each key is formed with a hardened face adapted to be engaged by a respective side of said projection.

5. The assembly of claim 2 wherein said fastener holes in said mounting flange have diameters oversized relative to said fasteners to thereby permit axial shifting of said keys within said U-shaped channel.

6. The assembly of claim 4 wherein said hardened face comprises hardened, wear resistant material.

7. The assembly of claim 3 wherein said fastener holes and said dowel holes alternate along said mounting flange.

8. The turbine assembly of claim 1 wherein said female fit component is located on said inner shell component and said male component is located on said outer shell component.

9. A method of aligning radially inner and outer turbine shell components each having upper and lower halves comprising:

a) providing a first pair of axial alignment fits between the upper halves of the radially inner and outer turbine shell components, and a second pair of axial fit components between the lower halves of the radially inner and outer turbine shell components, each axial alignment fit comprising a male fit component and a female fit component, the female fit component comprising a pair of tabs forming a U-shaped channel with opposed faces, and the male fit component comprising a projection adapted to be received within said U-shaped channel;

b) axially aligning said radially inner and outer shell components;

c) providing a pair of alignment keys for each axial alignment fit, each key having a mounting flange for securement along a respective outer edge of a respective one of said tabs, and an alignment flange engageable along a respective one of said opposed faces;

d) determining the precise location of said male fit component within said U-shaped channel;

e) machining one or both of each said pair of alignment keys along back faces of said alignment flanges to enable said precise location;

f) fastening said keys to said outer edges with a plurality of fasteners;

g) drilling dowel holes in said mounting flange and into said radial edge; and h) inserting dowel pins within said dowel holes.

10. The method of claim 9 wherein said alignment flange of each key is formed with a hardened face adapted to be engaged by a respective side of said projection.

11. The method of claim 9 wherein said mounting flange is provided with a plurality of fastener holes, and a like number of fasteners secure said mounting flange to said outer edge; and wherein said fastener holes in said mounting flange have diameters oversized relative to said fasteners to thereby permit axial shifting of said keys within said U-shaped channel.

12. The method of claim 9 wherein said hardened face comprise hardened, wear resistant material.

13. The method of claim 9 wherein said fastener holes and said dowel holes alternate along said mounting flange.

14. The turbine assembly of claim 9 wherein said female fit component is located on said inner shell component and said male fit component is located on said outer shell component.

15. An alignment key for a female fit component on a turbine shell component, said key comprising a mounting flange and an alignment flange, said mounting flange having a plurality of fastener holes therein that are oversized relative to fasteners adapted for use therewith; said alignment flange extending perpendicularly relative to said mounting flange, said alignment flange having a hardened face thereon.

16. The alignment key of claim 15 wherein said mounting flange is provided with a plurality of dowel holes.

17. The alignment key of claim 15 wherein said hardened face comprises hardened, wear resistant material.

18. The alignment key of claim 16 wherein said fastener holes and said dowel holes alternate along said mounting flange.

* * * * *